US005240014A

United States Patent [19]

Deevi et al.

[11] Patent Number: 5,240,014

[45] Date of Patent: Aug. 31, 1993

[54] CATALYTIC CONVERSION OF CARBON MONOXIDE FROM CARBONACEOUS HEAT SOURCES

[75] Inventors: Seetharama C. Deevi, Midlothian; Mohammad R. Hajaligol, Richmond; Diane S. Kellogg, Ashland; Bruce E. Waymack, Prince George, all of Va.

[73] Assignee: Philip Morris Incorporated, New York, N.Y.

[21] Appl. No.: 556,732

[22] Filed: Jul. 20, 1990

[51] Int. Cl.[5] ..... A24D 1/18

[52] U.S. Cl. ..... 131/334; 131/331; 131/359

[58] Field of Search ..... 131/194

[56] References Cited

U.S. PATENT DOCUMENTS

| | | | |
|---|---|---|---|
| 3,355,317 | 11/1967 | Keith et al. | 131/334 |
| 3,790,662 | 2/1974 | Lloyd et al. . | |
| 3,909,455 | 9/1975 | Rainer et al. . | |
| 4,252,687 | 2/1981 | Dale et al. . | |
| 4,256,609 | 3/1981 | Dale et al. . | |
| 4,317,460 | 3/1982 | Dale et al. . | |

FOREIGN PATENT DOCUMENTS

| | | | |
|---|---|---|---|
| 1185887 | 3/1970 | United Kingdom | 131/355 |

OTHER PUBLICATIONS

Kojima et al., "Catalysis by Transition Metal Carbides", Jol. of Catalysis, 73, pp. 128-135 (1982).

Imamura et al., "Oxidation of Carbon Monoxide Catalyzed by Manganese—Silver Composite Oxides", Jol. of Catalysis, 109, pp. 198-205 (1988).

J. W. Reynolds, "Results of Experimental Work To Remove CO From A Mixture Of $O_2$ and $N_2$ By Use of Modified Cigarette Filters", Publication from Research Laboratories/Tennessee Eastman Co.

Chapter 6 "Removal Of Carbon Monoxide", pp. 97-117, Catalyst Handbook, Wolfe Scientific Books London (1970).

*Primary Examiner*—V. Millin

*Assistant Examiner*—J. Doyle

*Attorney, Agent, or Firm*—Joseph M. Guiliano; Marta E. Gross

[57] ABSTRACT

An improved carbonaceous heat source suitable for use in a smoking article is provided. The heat source is formed by mixing a carbon component, a catalytic precursor and a binder, forming the mixture into a shape, and supplying heat to the mixture. Upon combustion of the heat source, the catalytic precursor forms a catalyst that converts carbon monoxide produced during combustion of the heat source into a benign substance.

43 Claims, 3 Drawing Sheets

CATALYTIC CONVERSION OF CARBON MONOXIDE FROM CARBONACEOUS HEAT SOURCES

BACKGROUND OF THE INVENTION

This invention relates to an improved carbonaceous heat source and to the catalytic conversion of gaseous by-products, such as carbon monoxide, produced by the combustion of the carbonaceous heat sources to a benign substance. The methods and heat source of this invention are particularly suitable for use in a smoking article such as that described in commonly assigned U.S. Pat. No. 4,991,606. The heat sources of this invention comprise carbon and smaller amounts on a weight basis of a metal species. The heat sources of this invention have low ignition and high combustion temperatures that generate sufficient heat to release a flavored aerosol from a flavor bed for inhalation by the smoker. Upon combustion, the catalytic component of the heat sources converts substantially all of the carbon monoxide to a benign substance.

According to the method of this invention, a carbon component is mixed with a metal species. Upon combustion, the metal species generates in situ a catalyst which converts the carbon monoxide by-product formed by combustion of the heat source to a benign substance. In a preferred embodiment, the metal species and carbon component are mixed together and then formed into a desired shape.

There have been previous attempts to provide a catalyst for the oxidation of carbon monoxide to carbon dioxide. These attempts have not produced a catalyst having all of the advantages of the present invention.

For example, Dale U.S. Pat. No. 4,317,460 discloses an oxidation catalyst adsorbed onto a solid support. The catalyst may be located in either a smoking article or in a filter tip.

Leary et al. *Journal of Catalysis*, 101, pp. 301-13 (1986) refers to a catalyst for the oxidation of carbon monoxide produced by an internal combustion engine. These catalysts, however, are derived from expensive metals.

Haruta et al., *Journal of Catalysis*. 115, 301-309 (1989) refers to production of an oxidation catalyst for the low-temperature conversion of carbon monoxide.

Walker et al., *Journal of catalysis*, 110, pp. 298-309 (1988) refers to an iron oxide-based catalyst for the simultaneous oxidation of carbon monoxide and propane.

It would be desirable to provide an inexpensive heat source which comprises a catalyst for the oxidation of carbon monoxide.

It would be desirable to provide an oxidation catalyst that is active at a broad range of temperatures, i.e., from above room temperature to about those reached in a combusting carbonaceous heat source.

It would be desirable to provide a carbonaceous heat source in which an oxidation catalyst of high activity is generated in situ during combustion of the heat source.

It would be desirable to provide a carbonaceous heat source that has a low temperature of ignition to allow for easy lighting under conditions typical for a conventional cigarette, while at the same time providing sufficient heat to release flavors from a flavor bed.

It would be further desirable to provide a carbonaceous heat source which does not self-extinguish prematurely.

It would be desirable to provide a carbonaceous heat source which liberates virtually no carbon monoxide.

SUMMARY OF THE INVENTION

It is an object of this invention to provide a heat source which comprises an inexpensive catalyst for the conversion of carbon monoxide to a benign substance. As used herein, a "benign substance" is a substance which, in the amounts produced by the heat source, possesses minimal toxicity, such as carbon dioxide, carbonate, or carbon.

It is also an object of this invention to provide a catalyst that is active at a broad range of temperatures, i.e., from above room temperature to about those reached in a combusting carbonaceous heat source.

It is a further object of this invention to provide a carbonaceous heat source in which a catalyst of high activity is generated in situ during combustion of the heat source.

It is yet a further object of this invention to provide a carbonaceous heat source that has a low temperature of ignition to allow for easy lighting under conditions typical for a conventional cigarette, while at the same time providing sufficient heat to release flavors from a flavor bed.

It is also an object of this invention to provide a carbonaceous heat source which does not self-extinguish prematurely.

It is a further object of this invention to provide a carbonaceous heat source which liberates virtually no carbon monoxide.

In accordance with this invention, there is provided a heat source which is particularly useful in a smoking article. The heat source is formed from materials having a substantial carbon content. Preferably, the heat source comprises carbon, with a smaller amount of a metal species. Burn additives may be added to promote complete combustion and to provide other desired burn characteristics.

Upon combustion of the heat sources of this invention, the carbon component is oxidized to form carbon monoxide and carbon dioxide. Simultaneously, the metal species is oxidized, not only generating heat, but also producing a catalyst which promotes the conversion of carbon monoxide to a benign substance.

According to the method of this invention, a carbon component and a metal species are combined with a binder, and optionally with a solvent. Preferably, the carbon component/metal species mixture is formed into a desired shape. The carbon component/metal species mixture is heated to vaporize the solvents and devolatilize the binder. The product of the heating step is a heat source which has retained the original shape of the carbon component/metal species mixture. While the heat sources of this invention are particularly useful in smoking devices, it is to be understood that they are also useful as heat sources for other applications, where having the characteristics described herein are desired.

BRIEF DESCRIPTION OF THE DRAWINGS

The above and other objects and advantages of this invention will be apparent upon consideration of the following detailed description taken in conjunction with the accompanying drawings, in which like reference characters refer to like parts throughout, and in which.

DETAILED DESCRIPTION OF THE INVENTION

Figure 1:
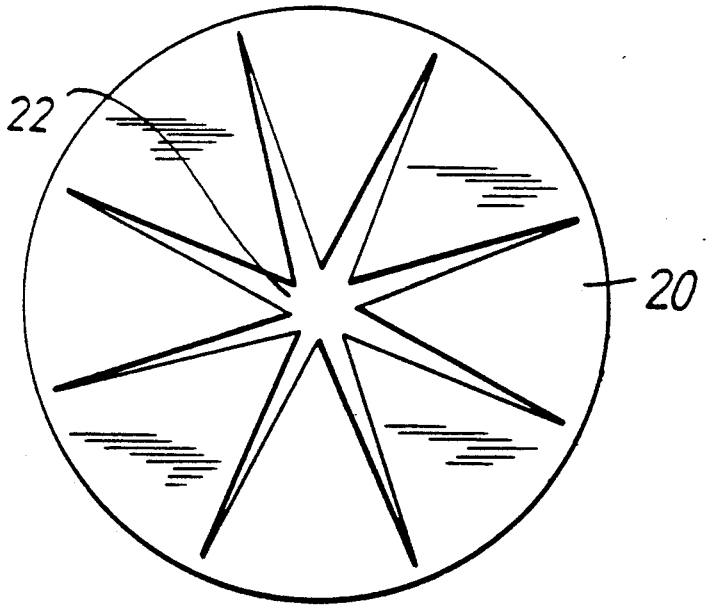
FIG. 1 depicts an end view of one embodiment of the heat source of this invention.
Figure 2:
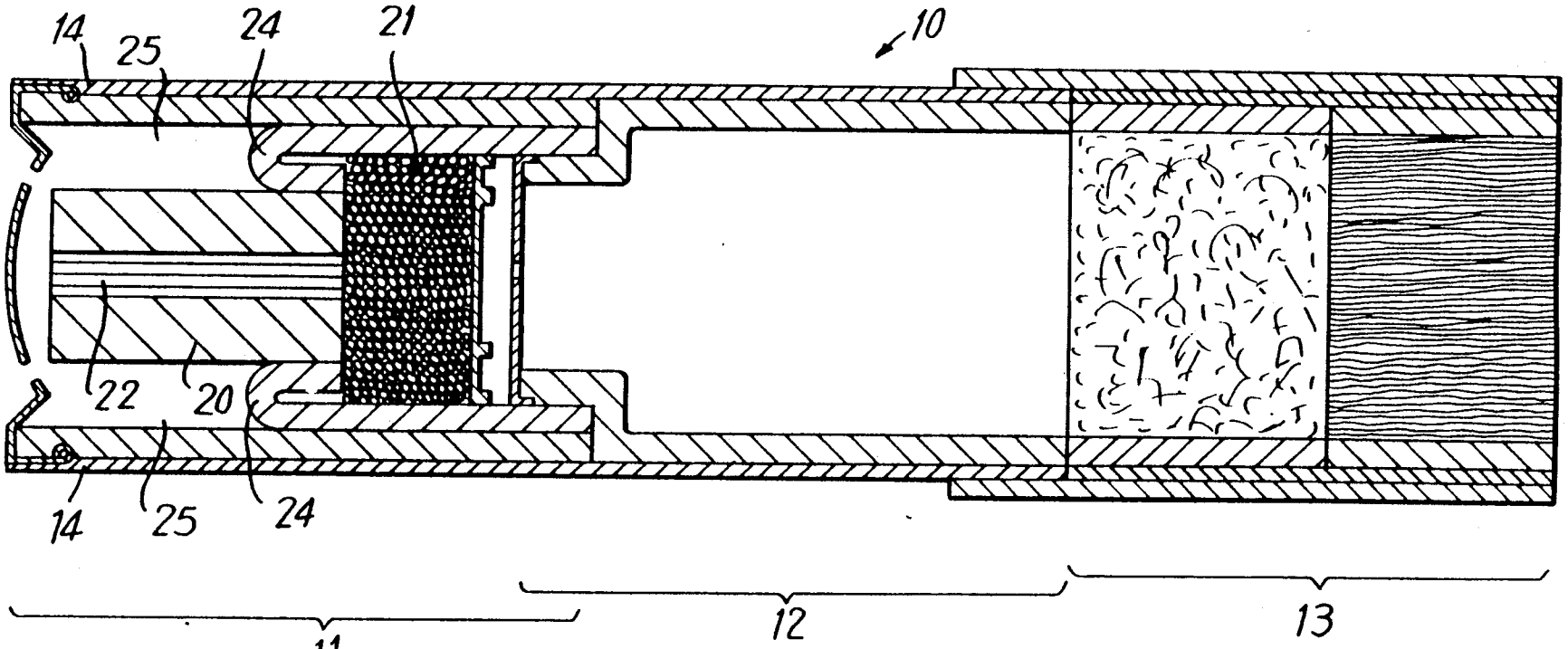
FIG. 2 depicts a longitudinal cross-sectional view of a smoking article in which the heat source of this invention may be used.

Smoking article 10 consists of an active element 11, an expansion chamber tube 12, and a mouthpiece element 13, overwrapped by a cigarette wrapping paper 14. Active element 11 includes a carbon component/metal species heat source 20 and a flavor bed 21 which releases flavored vapors when contacted by hot gases flowing through heat source 20. The vapors pass into expansion chamber tube 12, forming an aerosol that passes to mouthpiece element 13, and then into the mouth of a smoker.

Heat source 20 should meet a number of requirements in order for smoking article 10 to perform satisfactorily. It should be small enough to fit inside smoking article 10 and still burn hot enough to ensure that the gases flowing therethrough are heated sufficiently to release enough flavor from flavor bed 21 to provide flavor to the smoker. Heat source 20 should also be capable of burning with a limited amount of air until the carbon combusting in the heat source is expended. Upon combustion, heat source 20 should produce substantially no carbon monoxide.

Heat source 20 should have a surface area preferably in the range of about 3 $m^2/g$ to about 600 $m^2/g$, more preferably about 10 $m^2/g$ to about 200 $m^2/g$. Additionally, the heat sources of this invention may contain macropores (pores of between about 1 micron and about 5 microns in size), mesopores (pores of between about 20Å and about 500Åin size), and micropores (pores of up to about 20Å in size).

Heat source 20 should have an appropriate thermal conductivity. If too much heat is conducted away from the burning zone to other parts of the heat source, combustion at that point will cease when the temperature drops below the extinguishment temperature of the heat source, resulting in a heat source which is difficult to light and which, after lighting, is subject to premature self-extinguishment. Such extinguishment is also prevented by having a heat source that undergoes essentially 100% combustion. The thermal conductivity should be at a level that allows heat source 20, upon combustion, to transfer heat to the air flowing through it without conducting heat to mounting structure 24. Oxygen coming into contact with the burning heat source will almost completely oxidize the heat source, limiting oxygen release back into expansion chamber tube 12. Mounting structure 24 should retard oxygen from reaching the rear portion of the heat source 20, thereby helping to extinguish the heat source after the flavor bed has been consumed. This also prevents the heat source from falling out of the end of the smoking article.

The carbon component of the heat source is in the form of substantially pure carbon, although materials which may be subsequently converted to carbon may be also used. Preferably, the carbon component is colloidal graphite, and, more preferably, activated carbon or activated charcoal.

The metal species may be any metal-containing compound capable of being converted to a metal oxide with catalytic properties. Preferably, the metal species is selected from the group consisting of carbides of aluminum, titanium, tungsten, manganese, niobium, or mixtures thereof. A more preferred metal carbide is iron carbide having the formula $Fe_xC$, where X is between 1 and 3 inclusive. Most preferably, the iron carbide has the formula $Fe_5C_2$. One skilled in the art will understand that metal species often exist in polymorphous forms called phases. A selection may be made among the phases of a particular metal species without departing from the method of the present invention or the course of the catalytic reaction.

Metal carbides are hard, brittle materials, which are reducible to powder form. Iron carbides consist of at least two well-characterized phases—$Fe_5C_2$, also known as Hägg's compound, and $Fe_3C$, referred to as cementite. The iron carbides are highly stable, interstitial crystalline molecules and are ferromagnetic at room temperature. $Fe_5C_2$ has a reported monoclinic crystal structure with cell dimensions of 11.56 angstroms by 4.57 angstroms by 5.06 angstroms. The angle $\beta$ is 97.8 degrees. There are four molecules of $Fe_5C_2$ per unit cell. $Fe_3C$ is orthorhombic with cell dimensions of 4.52 angstroms by 5.09 angstroms by 6.74 angstroms. $Fe_5C_2$ has a Curie temperature of about 248 degrees centigrade. The Curie temperature of $Fe_3C$ is reported to be about 214 degrees centigrade. J. P. Senateur, *Ann. Chem.*, vol. 2, p. 103 (1967).

The carbon component/metal species mixture should be in particulate form. Preferably, the particle size of the metal species and carbon component should range up to about 300 microns. More preferably, the particle size of the metal species should range in size between about submicron and about 20 microns, while the particle size of the carbon component should range in size between about submicron and about 40 microns. The particles may be prepared at the desired size, or they may be prepared at a larger size and ground down to the desired size.

The surface areas of the metal species and the carbon component particles are critical. The greater the surface area, the greater the reactivity of the metal species and the carbon component, resulting in a more efficient heat source and catalytic species. Preferably, the surface area of the metal species particles ranges from between about 0.2 $m^2/g$ to about 400 $m^2/g$. More preferably, the metal species particles have a surface area of between about 1 $m^2/g$ and about 200 $m^2/g$. Preferably, the carbon component particle ranges in surface area between about 0.5 $m^2/g$ and about 2000 $m^2/g$. More preferably, the carbon component particle surface area ranges between about 100 $m^2/g$ and about 600 $m^2/g$.

In combining the carbon component and the metal species, a sufficient amount of metal species should be added to yield enough catalyst to oxidize virtually all carbon monoxide generated during combustion. Preferably, the metal species should range up to about 45% by weight of the carbon component/metal species, and, more preferably, between about 0.5% and about 25% by weight of carbon component/metal species mixture.

The carbon component and the metal species may be combined in a solvent. Any solvent which increases the fluidity of the carbon component/metal species mixture and does not affect either the combustion of the carbon component or the conversion of the metal species to a catalyst may be used. Preferred solvents are polar solvents, such as methanol, ethanol, acetone, and, most preferably, water.

The carbon component/metal species mixture may then be combined with a binder which confers greater mechanical stability to the carbon component/metal species mixture. The carbon component/metal species mixture can be combined with the binder using any convenient method known in the art.

Any number of binders can be used to bind the particles of the carbon component/metal species mixture. Preferred binders are organic binders, including carbohydrate derivatives such as carboxymethylcellulose, methylcellulose, sodium carboxymethylcellulose, and hydroxypropylcellulose; starches; alginates; gums, such as guar gum; konjac flour derivatives, such as "Nutricol," available from Factory Mutual Corporation, Philadelphia, Pa., and the like. More preferred binders are inorganic binders such as kaolin clay, ball clay, bentonite, soluble silicates, organic silicates, soluble phosphates, and soluble aluminates. A most preferred binder is XUS 40303.00 Experimental Ceramic Binder, available from Dow Chemical Company. The binder material may be used in combination with other additives such as potassium citrate, sodium chloride, vermiculite or calcium carbonate.

The carbon component/metal species mixture may be formed into a desired shape. Any method capable of forming the mixture into a desired shape may be used. Preferred methods of manufacture include slip casting, injection molding, and die compaction, and, most preferably, extrusion.

The method by which the heat source is manufactured will determine the amount of binder added to the carbon component/metal species mixture. Preferably, between about 2% and about 20% binder is added to the carbon component/metal species mixture, based upon the weight of the combustible material. More preferably, between about 3% and 10% binder is added to the carbon component/metal species mixture.

Any desired shape may be used in the method of this invention. Those skilled in the art will understand that a particular application may require a particular shape. In a preferred embodiment, the mixture is formed into an elongated rod. Preferably, the rod is about 30 cm in length. The diameter for heat source 20 may range from about 3.0 mm to about 8.0 mm; preferably the heat source has a diameter of between about 4.0 mm and about 5.0 mm. A final diameter of about 4.0 mm allows an annular air space around the heat source without causing the diameter of the smoking article to be larger than that of a conventional cigarette. The rods before baking are called green rods. Because variations in the dimensions of the rods may occur during baking (see discussion, infra), it is preferable to form the green rods at a slightly larger diameter than the final diameter of the heat source.

In order to maximize the transfer of heat from the heat source to flavor bed 21, one or more air flow passageways 22, as described in commonly assigned U.S. Pat. No. 5,076,296, may be formed through or along the circumference of heat source 20. The air flow passageways should have a large geometric surface area to improve the heat transfer to the air flowing through the heat source. The shape and number of the passageways should be chosen to maximize the internal geometric surface area of heat source 20. Preferably, when longitudinal air flow passageways such as those depicted in FIG. 1 are used, maximization of heat transfer to the flavor bed is accomplished by forming each longitudinal air flow passageway 22 in the shape of a multi-pointed star. Even more preferably, as set forth in FIG. 1, each multi-pointed star should have long narrow points and a small inside circumference defined by the innermost edges of the star. These star-shaped longitudinal air flow passageways provide a larger area of heat source 20 available for combustion, resulting in a greater volume of composition involved in combustion, and therefore a hotter burning heat source.

The green rods are then placed on graphite sheets which are stacked one over the other in a stainless steel container or on a stainless steel frame. The container containing the stacked graphite sheets is then placed in a heating or baking device such as a muffle furnace or a sagger. Preferably, the heating device is pressurized slightly above one atmosphere to prevent diffusion of gases from the external atmosphere to within the heating device.

Figure 3:
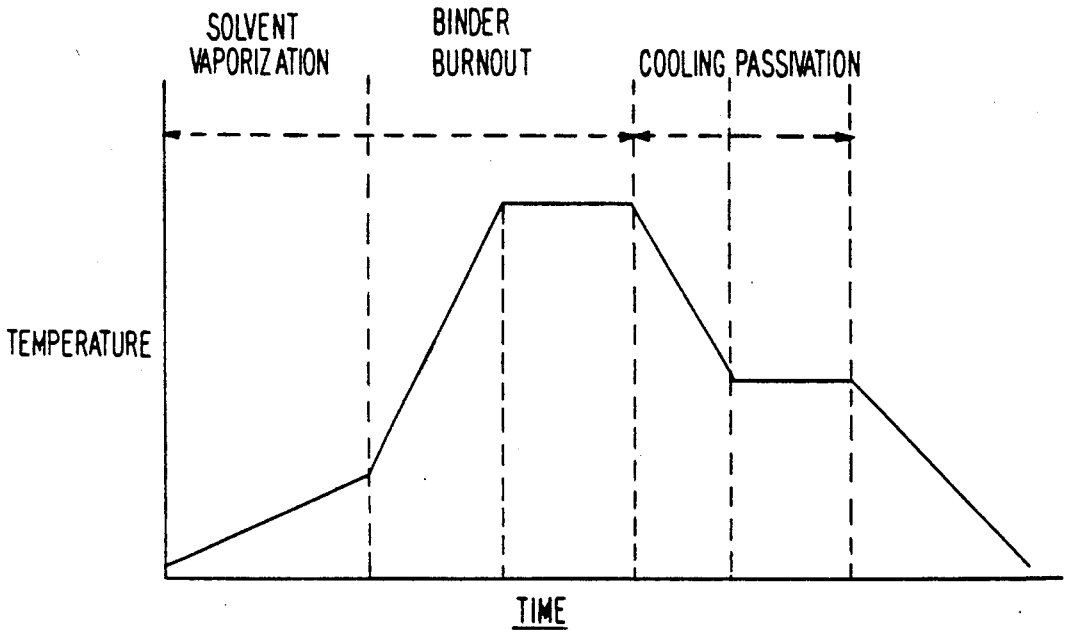
FIG. 3 depicts a heat vs. reaction time for the chemical conversion of the green rods. The origin at FIG. 3 is the point at which heat is applied to the carbon component/metal species mixture.

The conversion of the green rods may be accomplished by supplying heat. Heat may be supplied in a variety of ways as follows: 1) so that a constant temperature is maintained; 2) in a series of intervals; 3) at an increasing rate, which may be either constant or variable; or 4) combinations thereof. Additionally, steps such as allowing the rods to cool may be employed. Preferably, however, heat is supplied, as described in FIG. 3, in a multiple stage baking process. Those skilled in the art will understand that thermal processes (such as solvent vaporization and binder burnout) may occur at a wide variety of temperatures and pressures.

Binder burnout involves the vaporization of any solvent present in the rod as well as the devolatilization of the binder. Binder burnout is accomplished by gradually supplying heat to the rod under an inert atmosphere such as helium, nitrogen, or argon, or in a vacuum. It is preferable to supply heat to the rod at a first, low rate of increase, followed by a second, greater rate of increase.

The first low rate of temperature increase allows for vaporization of any solvent present in the rod without formation of ruptures and cracks in the rod. Additionally, a low rate of temperature increase minimizes warping and bending of the rod. The initial rate of increase should be between about 0.1° C./min to about 10° C./min, and preferably in the range of about 0.2° C./min to about 5° C./min. This rate of increase is maintained until a temperature in the range of about 100° C. to about 200° C., and a more preferable temperature is about 125° C., is reached and all solvents are vaporized.

Once the solvent in the rod has been vaporized, the rate of heating is increased to further volatilize binders in the rod. If present, carbonaceous binders begin to decompose at temperatures in the range of about 200° C. to about 300° C. to a gaseous mixture comprising carbon monoxide and carbon dioxide. Consequently, the rate of heating should be such that the evolution of gaseous products from the rod is sufficiently slow to minimize microexplosions of gaseous products that might adversely affect the structural integrity of the rod. Preferably, the rate of temperature increase should be in the range of about 1° C./min to about 20° C./min and more preferably, in the range of about 5° C./min to about 10° C./min. The temperature is increased at this rate until the maximum temperature is reached and the binders are decomposed. Preferably, the maximum temperature is between about 400° C. to about 700° C., and more preferably in the range of about 450° C. to about 600° C.

The maximum temperature and the length of time the rods remain at the maximum temperature determines the strength of the rod and its chemical composition. The strength of the rod should be sufficient to withstand high speed manufacturing processes, although the strength of the rod may be adjusted to match a particular application.

As stated above, variations in the dimensions of the rod will occur during baking. Generally, between about 10% and about 20% change will occur as a result of the binder burnout. This change in volume may cause warping or bending. The rod may also suffer inconsistencies in diameter. Following baking, therefore, the rod may be tooled or ground to the dimensions described above. The elongated rod is then cut into segments of between about 8 mm to about 20 mm, preferably between about 10 mm and about 14 mm.

The rod produced by this method comprises carbon and smaller amounts of a metal species. The carbon component has a sufficiently low ignition temperature, to allow for ignition under the conditions for lighting a conventional cigarette. Upon combustion of the heat source, the metal species is converted in situ to a highly reactive catalyst. In addition, the heat generated during combustion of the metal species releases flavors from the flavor bed and prevents premature self-extinguishment of the heat source.

Following ignition, the carbon component of heat source 20 combusts to produce, among other products, carbon monoxide. While not wishing to be bound by theory, it is believed that upon combustion, the metal species is converted into a metal oxide, most likely a fully oxidized metal oxide. It is believed the metal oxide is highly porous and is, therefore an extremely reactive catalyst which converts carbon monoxide to a benign substance such as carbon dioxide, carbonate, or carbon.

Preferably, the catalyst is capable of catalyzing oxidation or reduction reactions. For example, if the metal oxide formed is a reduction catalyst, then the benign substance will be carbon. If the metal oxide functions as an oxidation catalyst, the substance will be carbon dioxide. In the preferred embodiment, the catalyst is an oxidation catalyst. One skilled in the art of catalysis will understand that the exact composition of a metal catalyst is rarely known, and that the terms "reduction" and "oxidation" are sufficient to describe a metal catalyst.

The ignition temperature of the heat source is preferably in the range of between about 175° C. and about 450° C., and, more preferably between about 190° C. and about 400° C. Upon ignition, the heat sources reach a maximum temperature preferably between about 600° C. and about 950° C. and, more preferably, between about 650° C. and about 850° C. The maximum temperature will depend in part upon the smoking conditions and any materials in contact with the heat source as well as the availability of oxygen. The maximum temperature will also depend on the composition of the heat source. For example, when the metal species is a metal carbide, the ignition temperature may be lower because metal carbides are substantially easier to light than conventional carbonaceous heat sources and less likely to self-extinguish, but at the same time can be made to smolder at lower temperatures, thereby minimizing the risk of fire.

The heat sources made by the method of this invention are stable under a broad range of relative humidity conditions and aging times. For example, aging of heat sources for up to three months under a variety of relative humidity conditions ranging from about 0% relative humidity to about 100% relative humidity should have virtually no effect on the combustion products. Furthermore, the heat sources should undergo virtually no change in dimensions upon aging.

EXAMPLE 1

In order to assess the effect of the addition of Fe-containing compounds on CO evolution from carbonaceous heat source materials, physical mixtures of activated carbon and Fe compounds were prepared and the gases evolved during combustion analyzed. $Fe_5C_2$, $Fe_3C$, and $Fe_2O_3$ were added to activated carbon at 1, 10 and 50% by weight of carbon. Approximately 25 mg of the mixture was placed in an $AlO_3$ boat with a thermocouple placed just underneath the surface of the sample. The sample boat was inserted into a quartz reaction tube inside an Au reflection tube furnace. 21% $O_2$/Ar gas was passed over the sample at 200 ml/min. The temperature of the tube furnace was raised at a rate of 20° C./min, and the evolved gases were swept into an inlet capillary of a quadropole mass spectrometer. After calibration, CO evolution reported as μg CO/mg sample was calculated.

| % weight of heat source | Evolved CO, μg/mg sample | | |
|---|---|---|---|
| | $Fe_5C_2$ | $Fe_3C$ | $Fe_2O_3$ |
| 1% | 452 | 541 | 487 |
| 10% | 168 | 423 | 184 |
| 50% | 28 | — | 30 |

These results indicate that reduction in CO evolution is more than can be attributed to simple dilution of the heat source with $Fe_2O_3$. $Fe_5C_5$ has the advantage of participating in the combustion process, as well as facilitating the production of $CO_2$.

We claim:

1. A method for producing a heat source, comprising the steps of:

(a) mixing a carbon component, a catalytic precursor, and a binder, wherein the catalytic precursor is a metal species which upon combustion of the heat source forms a catalyst for converting carbon monoxide produced during combustion of the heat source to a benign substance;

(b) forming the mixture into a shape; and (c) supplying heat to the mixture.

2. The method of claim 1, wherein the metal species is an iron species.

3. The method of claim 2, wherein the iron species is $Fe_5C_2$.

4. The method of claim 1, wherein the carbon component is selected from the group consisting of colloidal graphite and activated carbon.

5. The method of claim 1, wherein the heat is supplied to the mixture in a plurality of intervals.

6. The method of claim 1, wherein the heat is supplied to the mixture at a constant rate of increase.

7. The method of claim 5, wherein the heat is supplied to the mixture within the interval at a constant rate of increase.

8. The method of claim 6, wherein the rate of increase is up to about 20° C./min.

9. The method of claim 7, wherein the rate of increase is up to about 20° C./min.

10. The method of claim 6, wherein the heat is supplied to the mixture until a temperature of between about 400° C. and about 700° C. is reached.

11. The method of claim 7, wherein the heat is supplied to the mixture until a temperature of between about 400° C. and about 700° C. is reached.

12. The method of claim 5, wherein the heat is supplied to the mixture in two intervals.

13. The method of claim 12, wherein the heat is supplied to the mixture in the first interval at a first rate of increase and in the second interval at a second rate of increase.

14. The method of claim 13, wherein the first rate of increase is between about 0.1° C./min and about 10° C./min.

15. The method of claim 13, wherein the heat is supplied to the mixture in the first interval until a temperature of between about 100° C. and about 200° C. is reached.

16. The method of claim 13, wherein the first rate of increase is between about 0.2° C./min. and about 5° C./min and heat is supplied to the mixture in the first interval until a temperature of about 125° C. is reached.

17. The method of claim 13, wherein the second rate of increase is between about 1° C./min and about 20° C./min.

18. The method of claim 13, wherein the heat is supplied to the mixture in the second interval until a temperature of between about 400° C. to about 700° C. is reached.

19. The method of claim 13, wherein the second rate of increase is between about 5° C./min and about 10° C./min until a temperature of between about 450° C. and about 600° C. is reached.

20. The method of claim 1, wherein in step (b) the mixture is formed into a cylindrical rod.

21. The method of claim 1, wherein the metal species and carbon component are combined in a polar solvent.

22. The method of claim 21, wherein the polar solvent is water.

23. The method of claim 1, wherein the metal species is in particulate form having a particle size of up to about 300 microns.

24. The method of claim 1, wherein the metal species is in particulate form having a particle size between about submicron and about 20 microns.

25. The method of claim 1, wherein the metal species has a surface area of between about 0.2 $m^2/g$ to about 400 $m^2/g$.

26. The method of claim 1, wherein the metal species has a surface area of between about 1 $m^2/g$ and about 200 $m^2/g$.

27. The method of claim 1, wherein the carbon component is in particulate form having a particle size of up to about 300 microns.

28. The method of claim 1, wherein the carbon component is in particulate form having a particle size of between about submicron and 40 microns.

29. The method of claim 1, wherein the carbon component has a surface area of between about 0.5 $m^2/g$ and about 2000 $m^2/g$.

30. The method of claim 1, wherein the carbon component has a surface area of between about 100 $m^2/g$ and about 600 $m^2/g$.

31. A heat source comprising a carbon component and a catalytic precursor, wherein the catalytic precursor is a metal species which upon combustion of the heat source forms a catalyst for converting carbon monoxide produced during combustion of the heat source to a benign substance.

32. A heat source for use in a smoking article comprising a carbon component and a catalytic precursor, wherein the catalytic precursor is a metal species which upon combustion of the heat source forms a catalyst for converting carbon monoxide produced during combustion of the heat source to a benign substance.

33. The heat source of claim 32, wherein the heat source is substantially in the form of a cylindrical rod and has one or more fluid passages therethrough.

34. The heat source of claim 33, wherein the cylindrical rod has a diameter of between about 3.0 mm and about 8.0 mm, and a length of between about 4.0 mm and about 20 mm.

35. The heat source of claim 33, wherein the cylindrical rod has a diameter of between about 4.0 mm and about 5.0 mm.

36. The heat source of claim 33, wherein the cylindrical rod has a length of between about 10 mm and about 14 mm.

37. The heat source of claim 33, wherein the fluid passages are formed in the shape of a multipointed star.

38. The heat source of claim 33, wherein the fluid passages are formed as grooves around the circumference of the cylindrical rod.

39. A heat source comprising a carbon component and iron carbide of the formula $Fe_5C_2$.

40. The heat source of claim 39, wherein the heat source has an ignition temperature of between about 175° C. and about 450° C.

41. The heat source of claim 39, wherein the heat source has an ignition temperature of between about 190° C. and about 400° C.

42. The heat source of claim 39, wherein, upon combustion, the heat source reaches a maximum temperature of between about 600° C. and about 950° C.

43. The heat source of claim 39, wherein, upon combustion, the heat source reaches a maximum temperature of between about 650° C. and 850° C.

* * * * *

UNITED STATES PATENT AND TRADEMARK OFFICE

CERTIFICATE OF CORRECTION

PATENT NO. : 5,240,014

DATED : August 31, 1993

INVENTOR(S) : Seetharama C. Deevi et al.

It is certified that error appears in the above-indentified patent and that said Letters Patent is hereby corrected as shown below:

Title page, item [54] and col. 1, lines 1-3,

Title, "CATALYTIC CONVERSION OF CARBON MONOXIDE FROM CARBONACEOUS HEAT SOURCES" should be -- CARBONACEOUS HEAT SOURCE INCLUDING A CATALYTIC PRECURSOR THAT FORMS A CATALYST UPON COMBUSTION OF THE HEAT SOURCE FOR CONVERSION OF CARBON MONOXIDE INTO A BENIGN SUBSTANCE --.

Column 7, line 8, "high speed" should be -- high-speed --.

Signed and Sealed this

Twenty-eighth Day of June, 1994

Bruce Lehman

*Attest:*

BRUCE LEHMAN

*Attesting Officer*

*Commissioner of Patents and Trademarks*